United States Patent [19]

Glaser et al.

[11] 4,178,217

[45] Dec. 11, 1979

[54] ZINC ELECTROPLATING BATH

[75] Inventors: Klaus Glaser, Mutterstadt; Werner Streit, Bobenheim; Rolf Fikentscher, Ludwigshafen; Guenther Gotsmann, Frankenthal, all of Fed. Rep. of Germany

[73] Assignee: BASF Aktiengesellschaft, Fed. Rep. of Germany

[21] Appl. No.: 937,912

[22] Filed: Aug. 30, 1978

[30] Foreign Application Priority Data

Sep. 9, 1977 [DE] Fed. Rep. of Germany ..... 2740592

[51] Int. Cl.[2] ..... C25D 3/22; C25D 3/24

[52] U.S. Cl. ..... 204/55 Y; 204/55 R

[58] Field of Search ..... 204/55 R, 55 Y, 114, 204/43 Z

[56] References Cited

U.S. PATENT DOCUMENTS

| | | | |
|---|---|---|---|
| 3,393,135 | 7/1968 | Rosenberg | 204/55 Y |
| 3,853,718 | 12/1974 | Creutz | 204/55 R |
| 4,101,387 | 7/1978 | Creutz et al. | 204/43 T |
| 4,135,992 | 1/1979 | Fikentscher et al. | 204/55 R |

FOREIGN PATENT DOCUMENTS

| | | | |
|---|---|---|---|
| 2614719 | 10/1976 | Fed. Rep. of Germany | 204/55 R |
| 1915653 | 4/1977 | Fed. Rep. of Germany | |

*Primary Examiner*—G. L. Kaplan

*Attorney, Agent, or Firm*—Keil & Witherspoon

[57] ABSTRACT

A zinc electroplating bath which contains polyalkylenepolyamines which possess alkyl and sulfoalkyl groups.

3 Claims, No Drawings

ZINC ELECTROPLATING BATH

The present invention relates to a zinc electroplating bath which contains a special brightener so as to give very bright, ductile zinc coatings.

In industrial practice, zinc coatings are deposited from alkaline cyanide-containing electrolytes, alkaline cyanide-free electrolytes or acid electrolytes. Each of these types of bath has its specific area of use in industrial practice.

Alkaline zinc electrolytes in particular contain zinc in the form of cyanide complexes and give good results, but are not universally applicable, because of the toxicity of the effluent.

Acid baths are in some cases—depending on the composition of the bath—corrosive. However, they have found acceptance wherever hardened metal articles, cast iron, mass-produced articles of simple design, sheets, tubes or rods, and the like, are to be provided with a very bright zinc coating.

Alkaline cyanide-free types of bath are being employed increasingly but have not yet acquired the same importance as the other two types, since they are more difficult to operate in industrial practice and since it has not yet proved possible to deposit very bright, ductile and, in particular, firmly-adhering coatings from such baths in every case.

Various forms of brightener systems for these types of bath exist and are adequately described in the literature. They consist, in the main, of basic and high-gloss brighteners and are in each case selected to suit the particular electrolyte. Hitherto, it has not proved possible to employ one basic brightener for all the above types of bath, and furthermore the brighteners disclosed hitherto only give very bright coatings with frequently inadequate throwing power and, in some cases, severe embrittlement, or give dull but ductile coatings.

It is an object of the present invention to provide a basic brightener which is equally suitable for all types of bath and can be combined with all types of high-gloss brighteners.

We have found that this object is achieved, surprisingly, by adding, to the plating baths, a particular nitrogen-containing polymer substituted by alkylsulfonate groups and alkyl groups.

The invention accordingly relates to an aqueous zinc electroplating bath which is used to produce very bright zinc coatings and which is acid or alkaline or contains alkali metal cyanide, and comprises a polyalkylenepolyamine as the brightener, wherein the brightener used is a polyalkylenepolyamine of the formula $$H_2N\text{-}[(CH_2)_n\text{—}NH]_xH$$

which is alkylated at the nitrogen by alkyl radicals of 1 to 4 carbon atoms and is additionally alkylated by alkyl radicals containing sulfo groups, n being from 2 to 4 and x from 5 to 120.

It is true that German Laid-Open Application DOS No. 2,614,719 and German Published application DAS No. 1,915,653 disclose that polyalkyleneamines which are substituted by alkanesulfonates but are not alkylated additionally, can be employed in zinc electroplating baths, but, as shown in the Examples, these compounds are basic brighteners which do not conform to present-day industrial requirements, since they only prove successful in baths of a special composition and are therefore not universally applicable.

Suitable nitrogen-containing polymers for the purposes of the invention are low molecular weight polyalkyleneimines containing from 5 to 120 alkyleneimine units, preferably compounds having a mean molecular weight of from about 200 to 20,000, especially from 400 to 2,000. Polyethyleneimines, poly-n-propyleneimines, poly-iso-propyleneimines and polybutyleneimines can be used, but polyethyleneimine and its hydrochloride are preferred.

The amount of alkylsulfonate radicals (alkyl radicals containing sulfonate groups) to be introduced into the polymer molecule per equivalent of basic nitrogen should be from 0.01 to 1.99 moles, preferably from 0.1 to 1 mole. Sulfoalkylating agents which may be used are alkylsultones, aliphatic saturated sulfonic acids which are substituted by at least one hydroxyl group and/or one halogen atom, and aliphatic unsaturated sulfonic acids. Instead of the sulfonic acids, their alkali metal salts, ammonium salts, zinc salts or cadmium salts may be used. Preferred sulfoalkylating agents to be mentioned are propanesultone, hydroxyethanesulfonic acid, 2-chloroethanesulfonic acid, 3-chloro-2-hydroxypropanesulfonic acid, 3-chloro-2-methylpropanesulfonic acid, 4-hydroxybutanesulfonic acid, vinylsulfonic acid, allylsulfonic acid, propynesulfonic acid, 2-propynoxy-1-ethanesulfonic acid, 2-propeneoxy-1-ethanesulfonic acid and hydroxyethoxy-ethanesulfonic acid.

Suitable alkylating agents are all conventional agents which provide alkyl groups of 1 to 4 carbon atoms. Preferred alkylating agents are alkyl halides, eg. methyl and ethyl chloride, bromide and iodide, dialkyl sulfates, eg. dimethyl sulfate and diethyl sulfate, and the formic acid/formaldehyde system. The ratio of alkyl groups to alkylsulfonate groups should be from 1:30 to 30:1, but preferably from 1:3 to 2:1.

Preferably, the brighteners are manufactured by first carrying out the sulfoalkylation and then the alkylation, since this gives the best results. The alkylation or sulfoalkylation is an operation familiar to those skilled in the art and therefore does not require any special comment.

The invention provides a surprising technical advance and is applicable to acid or alkaline zinc electrolytes and to alkaline zinc electrolytes containing cyanide; the polyalkylenepolyamine derivatives are of comparable effectiveness as basic brighteners in all these electrolytes.

Acid baths may be prepared by dissolving zinc oxide in a conventional acid, eg. hydrochloric acid, sulfuric acid, sulfamic acid or fluoboric acid. However, conventionally the baths are prepared by dissolving zinc ammonium sulfate, chloride, acetate, fluoborate or sulfamate in water and then bringing the pH to the desired range by means of aqueous ammonia, sodium hydroxide or other bases or, if necessary, by means of an acid. In general, the bath has a pH of from 3 to 7.5, preferably from 5 to 6.

The zinc content of the acid bath is conventionally from about 6 to 145 g/l, preferably from about 16 to 80 g/l.

Further additives which may be used are ammonium, potassium or sodium chloride or sulfate as a conductive salt, buffers, eg. boric acid, and surfactants, eg. ethoxylated nonylphenols and the like.

Alkaline cyanide-free zinc baths which contain from about 5 to 60 g/l of zinc in the main comprise the aqueous solution of an alkali metal zincate, eg. sodium zincate, and an excess of an alkali metal hydroxide, eg. sodium hydroxide, with or without an alkali metal carbonate, eg. sodium carbonate. The addition of complexing agents, eg. ethylenediaminetetraacetic acid, nitrolotriacetic acid, triethanolamine, polyphosphates and the like, has also been disclosed. However, because of their contaminant effect on the effluent, these complexing agents are in general employed less frequently.

Alkaline baths containing cyanide are usually operated at an alkali metal cyanide concentration of from 5 to 145 g/l and a zinc concentration of from 5 to 60 g/l, electrolytes of low cyanide concentration being preferred. Usually, the weight ratio of cyanide to zinc should be from about 0.1:1 to 3.5:1, preferably from about 1:1 to 2:1, at the low cyanide concentration values.

In all cases, the baths are usually operated at from 20° to 50° C.

The baths according to the invention, described above, can in addition contain other, conventional, brighteners, which may be used individually or as mixtures. Suitable brighteners of this type are, in particular, aromatic aldehydes, eg. anisaldehyde and vanillin and their bisulfite adducts, ketones, eg. benzalacetone, heterocyclic nitro compounds, eg. nitroimidazole, betaines, eg. benzylpyridinium carboxylate, or other imidazole derivatives, eg. the reaction product of ethylimidazole with epichlorohydrin. When such compounds are added—such addition being of advantage in a variety of cases, due to a synergistic action—it is advantageous to employ from 0.01 to 10 g/l, preferably from 0.1 to 3 g/l, of such compounds.

The polyalkylenepolyamine derivatives of the invention are present in an amount of from 0.01 to 50 g/l, preferably from 0.1 to 10 g/l.

The Examples which follow illustrate the invention without implying a limitation.

EXAMPLE 1

88.8 g of a 48.4 percent strength, aqueous solution of a polyethyleneimine having a mean molecular weight of 1,600 are reacted, at room temperature, with 213 g of a 25 percent strength aqueous solution of sodium propynesulfonate. The mixture is then stirred for four hours at 80° C., after which it is cooled to 40° C. and reacted with 78.8 g of dimethyl sulfate, whilst cooling. After a further two hours, at 80° C., all the dimethyl sulfate has reacted.

An electrolyte containing 7 g/l of Zn, in the form of $Zn(CN)_2$, 9.4 g/l of NaCN, 54 g/l of NaOH, 0.5 g/l of the above reaction product (calculated as 100% strength material) and 1.2 g/l of 1-benzylpyridinium 3-carboxylate is subjected to a Hall cell test, as described in DIN No. 50,957, for 10 minutes at a bath temperature of 25° C. A cell current of 1 A is used. Since the cathode is at an angle to the anode, this gives a current density range of from about 8 to about 0.2 $A/dm^2$.

To remove discolorations, the test sheet is then dipped in 0.5 percent strength nitric acid.

A very bright, ductile and readily chromatizable zinc coating is obtained in all zones, from the highest to the lowest current density.

EXAMPLE 2

The effect of background brighteners based on polyethyleneimine with alkanesulfonate substituents, and on polyethyleneimine with both alkanesulfonate and alkyl substituents, is compared in an alkaline cyanide-free type of bath.

(a) 30 g of concentrated hydrochloric acid are added to 66.6 g of a 48.4 percent strength solution of a polyethyleneimine having a mean molecular weight of 1,500. 284 g of a 25 percent strength solution of sodium propynesulfonate are then added at from 20° to 30° C. The mixture is then left to react for four hours at 80° C.

5 g/l of this substance are added to an electrolyte containing 9 g/l of ZnO, 80 g/l of NaOH, 25 g/l of $Na_2CO_3$, 650 mg/l of 1-benzylpyridinium 3-carboxylate and 100 mg/l of anisaldehyde-bisulfite.

The coating conditions chosen are as described in Example 1.

The resulting zinc coating was somewhat bright in the highest current density zone only, dull in the medium current density zone and from grey to black in the lowest current density zone.

(b) 30 g of concentrated hydrochloric acid are added to 66.6 g of a 48.4 percent strength aqueous solution of a polyethyleneimine having a mean molecular weight of 1,500. 284 g of a 25 percent strength solution of sodium propynesulfonate are then added at from 20° to 30° C. After completion of the reaction, 47.3 g of dimethyl sulfate are added and the mixture is left to react for four hours at 80° C.

Here again, 5 g/l of the material obtained are added to the zinc electrolyte described under 2(a), and the electroplating is carried out as described there.

An extremely bright and ductile zinc coating is obtained over the entire current density range, the throwing power being very high.

EXAMPLE 3

In this Example the background brighteners are again subject to a comparative test, as in Example 2, but in an acid zinc electrolyte bath.

(a) 277.4 g of a 46.5 percent strength aqueous solution of a polyethyleneimine having a mean molecular weight of about 1,400 are introduced into a flask. 520 g of an aqueous 25 percent strength sodium vinyl-sulfonate solution are added in the course of 40 minutes at room temperature, whilst stirring, and the mixture is then left to react for four hours at 80° C.

10.2 g/l of the resulting product are added to an electrolyte containing 100 g/l of $ZnCl_2$, 180 g/l of $NH_4Cl$, 6 g/l of Na benzoate, 5 g/l of an adduct of nonylphenol with 14 moles of ethylene oxide, 0.8 g/l of benzalacetone, 0.1 g/l of anisaldehyde-bisulfite and 0.1 g/l of heliotropine.

The test is carried out as described in DIN 50,957, in a 250 ml Hull cell, with slight agitation of the bath. The coating time is 10 minutes, with a current of 1 A.

The test sheet is bright in the low current density zone, but the coating is pitted and dull in the medium to high current density zone. Furthermore, the throwing power is not particularly high.

(b) 88.8 g of a 48.4 percent strength aqueous solution of a polyethyleneimine having a mean molecular weight of 1,400 are taken and 40 g of concentrated hydrochloric acid are added at room temperature. 195 g of a 25 percent strength aqueous solution of sodium vinylsulfonate are then added, again at room temperature, after which the mixture is left to react for four hours at 80° C. The solution is then cooled to 50° C. and 78.8 g of dimethyl sulfate are added, whilst cooling with ice. After a reaction time of two hours at 80° C., all the dimethyl sulfate has reacted.

10.2 g/l of this material are added to the electrolyte described under 3(a) and subjected to the same Hull cell test.

A very bright zinc coating is obtained over the entire current density range, the throwing power being good.

EXAMPLE 4

88 g of a 49 percent strength aqueous solution of a low molecular weight polyethyleneimine, having a mean molecular weight of about 800, are introduced into a vessel, 40 g of concentrated hydrochloric acid are added at room temperature and the mixture is then reacted with 216 g of an aqueous 25 percent strength solution of sodium allylsulfonate. The mixture is stirred for five hours at 80° C., then cooled to 40° C., and reacted with 63 g of dimethyl sulfate, whilst cooling. After a further period of about 90 minutes at 80° C., the reaction is complete.

3.8 g/l of this material are added to an electrolyte containing 21 g/l of $ZnCl_2$, 115 g/l of NaOH, 35 g/l of $Na_2CO_3$, 1.1 g/l of 1-benzylpyridinium 3-carboxylate and 0.15 g/l of anisaldehyde-bisulfite.

After 10 minutes, a Hull cell test as described in DIN 50,957 (cf. Example 1) gives very bright, haze-free and ductile coatings.

We claim:

1. In an aqueous zinc electroplating bath which is used to produce very bright zinc coatings and which is acid or alkaline or contains alkali metal cyanide, and comprises a polyalkylene-polyamine as the brightener, the improvement wherein the brightener used is a compound prepared by alkylating a polyalkylenepolyamine of the formula $$H_2N\text{-}[(CH_2)_n\text{—}NH]_xH,$$

in which n denotes 2 to 4 and x 5 to 120, at the nitrogen by alkyl radicals of 1 to 4 carbon atoms and additionally alkylating the polyalkylene polyamine by alkyl radicals containing sulfo groups, the amount of the alkyl radicals containing sulfo groups to be introduced into the polyalkylene polyamine molecule being from 0.01 to 1.99 moles per equivalent of basic nitrogen, and the ratio of alkyl groups to alkyl radicals containing sulfo groups being from 1:30 to 30:1.

2. A zinc electroplating bath as set forth in claim 1, wherein the brightener is a polyalkylenepolyamine which contains alkyl and sulfoalkyl groups in the molar ratio of from 1:3 to 2:1.

3. A zinc electroplating bath as set forth in claim 1, wherein the brightener is a polyalkylenepolyamine which has first been sulfoalkylated and then alkylated.

* * * * *